US005150552A

United States Patent [19]

Davis-Arzac

[11] Patent Number: 5,150,552

[45] Date of Patent: Sep. 29, 1992

[54] BUILDING SYSTEM FOR EXTENSION OF PROGRESSIVE HOUSING

[76] Inventor: Craig Davis-Arzac, Pino Number 30, Colonia Florida, 01030, Mexico

[21] Appl. No.: 839,292

[22] Filed: Feb. 26, 1992

Related U.S. Application Data

[63] Continuation of Ser. No. 431,111, Nov. 3, 1989.

[30] Foreign Application Priority Data

May 19, 1989 [MX] Mexico ..... 16107

[51] Int. Cl.[5] ..... E04B 1/00

[52] U.S. Cl. ..... 52/259; 52/260

[58] Field of Search ..... 52/204, 259, 260, 263, 52/722, 723, 747, 491, DIG. 12, 378, 379

[56] References Cited

U.S. PATENT DOCUMENTS

| | | | |
|---|---|---|---|
| 1,071,045 | 8/1913 | Graa | 52/722 |
| 1,906,108 | 4/1933 | Schlueter | 52/723 |
| 2,420,427 | 5/1947 | Henderson | 52/296 X |
| 2,841,975 | 7/1958 | Bruckmayer | 52/491 X |
| 2,912,849 | 11/1959 | Wissinger | 52/723 X |
| 3,007,541 | 11/1961 | Mast | 52/DIG. 12 X |
| 3,151,464 | 10/1964 | Sato et al. | 52/722 X |
| 3,490,191 | 1/1970 | Ekblom | 52/263 X |
| 3,800,490 | 4/1974 | Conte | 52/263 X |
| 3,801,685 | 4/1974 | Bell | 52/263 X |
| 4,106,247 | 8/1978 | Svensson | 52/204 |
| 4,231,199 | 11/1980 | Gomez | 52/204 X |
| 4,236,361 | 12/1980 | Boden | 52/204 |
| 4,409,764 | 10/1983 | Wilnau | 52/204 X |
| 4,439,959 | 4/1984 | Helfman | 52/204 X |
| 4,472,916 | 9/1984 | Krebs | 52/263 X |
| 4,476,662 | 10/1984 | Fisher | 52/263 X |
| 4,565,044 | 1/1986 | Takahara | 52/204 X |
| 4,573,295 | 3/1986 | Wilkinson | 52/747 X |
| 4,622,796 | 11/1986 | Aziz | 52/747 |

FOREIGN PATENT DOCUMENTS

| | | | |
|---|---|---|---|
| 2206726 | 8/1973 | Fed. Rep. of Germany | 52/DIG. 12 |

*Primary Examiner*—David A. Scherbel
*Assistant Examiner*—Robert J. Canfield
*Attorney, Agent, or Firm*—Armstrong, Nikaido, Marmelstein, Kubovcik & Murray

[57] ABSTRACT

A building method and system for the progressive construction of extensions in a dwelling, where the layout of the extension has been previously established. The system is composed of three stages. In the first stage, only the necessary foundations are built, a limited number of precast vertical wall reinforcements and a temporay roofing are installed. In the second stage, load bearing walls are erected and fixed to the initial vertical wall reinforcements with mortar keys that fill indentations in the precast elements, complimentary wall reinforcements are poured and lintels, doors and windows are installed. In the third stage, the temporary roofing is relocated at a second extension while in the first extension a permanent slab is built and the interior partitions and finishes are installed. The vertical wall reinforcements are cast concrete members of rectangular cross section, have internal longitudinal and transverse reinforcing bars, and are formed with a plurality of indentations of trapezoidal, rectangular, semi-circular or triangular cross section shape cast in the outer surface.

6 Claims, 21 Drawing Sheets

BUILDING SYSTEM FOR EXTENSION OF PROGRESSIVE HOUSING

This application is a continuation of Application Ser. No. 431,111, filed on Nov. 3, 1989.

BACKGROUND OF THE INVENTION

1. Field of Application

The present invention is related to the building industry and deals particularly with an improved system for the enlargement of pre-existant buildings, in a gradual, simple and inexpensive way.

Such a system has been a long sought objective for low income families whose savings need be immediately used and maximized.

This system would prove to be not only desirable but necessary in countries with high demographic growth and a low income per capita.

Recently in Mexico and other contries the housing problem was worsened alarmingly due to such factors as population growth, lack of financial resources, scarce specialized labour and the rising cost of building materials.

In the case of Mexico, it is estimated that during the next ten years more than 8,000,000 low income families with hardly any access to credit will be in need of a dwelling. Therefore, the building of these dwellings will depend on the small amounts of capital saved by each family through a long period of time.

Thus, a great mass of effective demand will be characterized as an atomized demand. one which needs and can purchase small portions of a dwelling. To prove this point we only need to walk through any squatter settlement and see a multitude of construction signs pointing to the future development of the dwellings, specially obvious are: piles of building material, foundations without walls, walls without slabs, temporary constructions and the everpresent steelbars protruding from concrete elements.

In Mexico the public sector finances aproximatly 30% of the dwellings for low income families, while the informal or social sector is responsable for the other 70%.

The investment currently undergone by the public sector in projects concerning sites and services, progressive construction, and improved housing justifies the participation of large enterprises. Nevertheless, due to a lack of appreciation of the informal market and the traditional inertia in the building industry we find that products now on the marketplace do not address the problems and possibilities posed by the gradual growth of construction.

Likewise in the informal sector, the size and singularity of each atom of demand inhibits the intervention of specialists and the efficient solution of design and construction problems. In a similar way the owner generally depends on low qualified labour including his own, this results in a large waste of resources and poor quality construction.

2. Description of the Previous Technique

Recent studies in Mexico indicate that 80% of the dwellings built use one variation of the so called traditional system characterized by load bearing walls made with a variety of brick types, the walls are reinforced with horizontal and vertical elements of reinforced concrete, and floor slabs and roofing generally made of reinforced concrete.

Whatever applies for the traditional system is also valid for any future extension of the building. As a result the building of an extension usually follows the next sequence: first, foundations are built, then the brickwork conforming the walls is laid and the vertical concrete reinforcements poured, next the steel bars of the horizontal wall reinforcements are placed and the concrete slab is built. In some instances before the slab is built temporary roofing is installed which is substituted for the slab in a later stage. The same procedure will be followed for extensions in upper levels obviously skipping the foundations.

In this manner, with the traditional system the brickwork will remain unstable until the vertical reinforcements are poured, and the reinforcements can not be poured until all the concurrent walls are built. This implies that all foundations, brickwork and vertical wall reinforcements must be built in order to atain a load bearing and stable structure.

When building with the previous technique, qualified personnel are required to establish the right spatial references so that the construction fulfils a pre-established geometry. For this reason poorly qualified or unskilled labour like the owner himself must always work under the supervision of qualified personnel.

The building technique previously described presents a series of problems that are of the greatest importance when dealing with the gradual extension of a building, since it can not effectively use the small capital flows that feed the construction of the dwelling in a gradual way.

One of the main disadvantages of the extensions built with the previous technique comes from a large underemployed capacity, which is fully used years later when the building is finally completed.

Another disadvantage of the previous technique results from the order of execution, because the vertical wall reinforcements are poured after the brickwork is laid they can not be used to support the guiding string which allows for the correct placement of each brick, furthermore, the brickwork will remain unstable until the vertical reinforcements are poured.

Given the above, all the brickwork and the vertical reinforcements must be concluded in a relatively short period of time with the permanent presence of qualified workmen. Furthermore, due to the temporary instability of the brickwork there is a real danger to workmen and to personnel in the surrounding areas.

Although the improved system of progressive construction has been focusing specifically on the extension of dwellings it is obvious that this type of construction may be used for any other purpose.

SUMMARY OF THE INVENTION

The principal objective of this invention is to present an improved building system that focuses on the gradual growth of construction with an immediate use of each unit invested.

Another objective of this invention is to present a pre-cast vertical wall reinforcement, to be used not only on said system but also on any other type of construction wherever brickwork is used to form load bearing or partition walls or wherever light structures or temporary roofings are required.

One advantage of the present invention is that a minimum investment enables the placing of a light roof which is immediately useful, while using the previous technique this same initial investment would only provide enough resources to excavate and build part of the foundations.

Another advantage of the system of this invention is that it will allow for a multiple reutilization of the temporary roofing.

The separation of qualified and unqualified labour is another advantage of the present invention. Marking the geometry of the extension with the initial vertical wall reinforcements allows for unqualified labour to continue building without the assistance of qualified personel. This is very advantageous considering that the owner generally applies his spare time to building.

Another advantage of the system of this invention is that the dwelling may grow by small increments immediately incorporating family savings into a useful project. Generally such savings will be applied to purchase building material which only after many years will it be of any use, and before this happens the investment will generate a so called negative utility, since material placed in the exterior

DETAILED DESCRIPTION OF THE INVENTION

Figure 1:
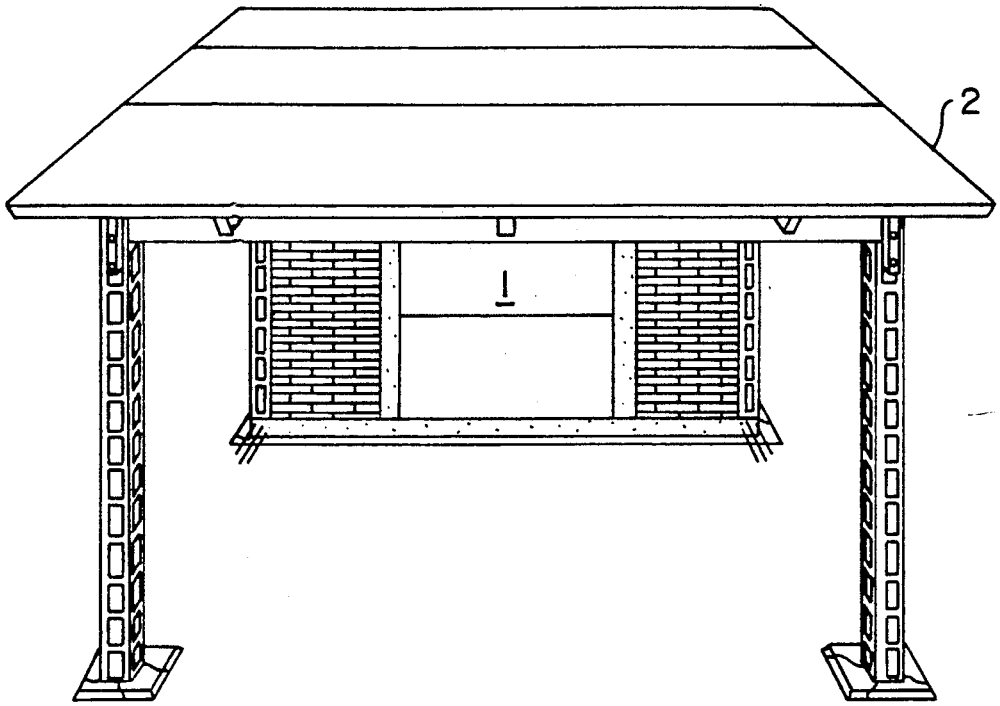
FIG. 1 is a perspective view showing the first stage of an extension built with the system of the present invention. It is compared with FIG. 2.
Figure 2:
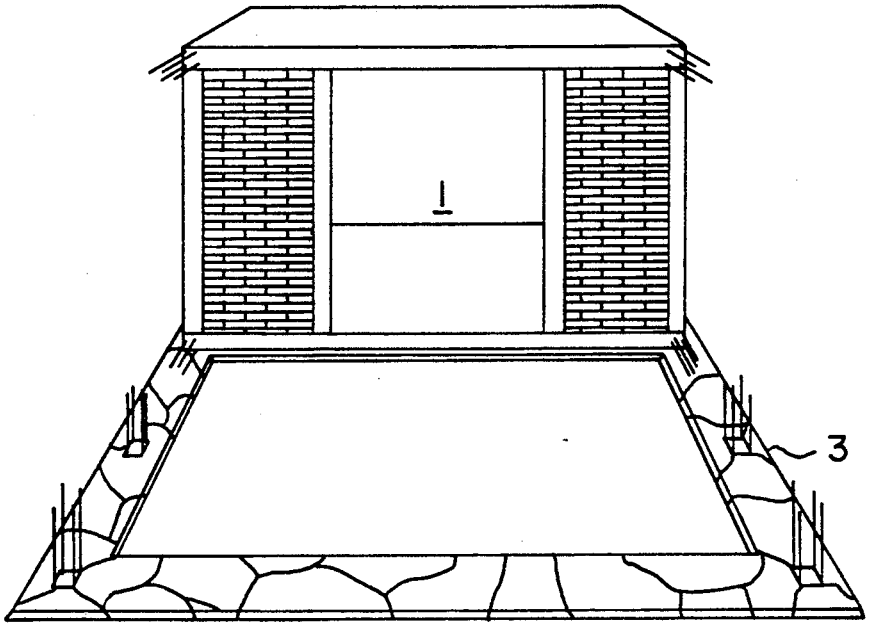
FIG.2 PRIOR ART
FIG. 2 is a view of a perspective showing what could be built using the previous technique and an investment equal to the one used to build the extension shown in FIG. 1.

The improved building system for the progressive extension of dwellings consists of a series of stages and components to be described in full as follows:

FIGS. 1 and 2 are a comparison of what can be accomplished with a given investment during a first stage of construction using the system of the present invention as shown by FIG. 1, and what could be achieved with the same amount invested and the traditional system, as shown by FIG. 2. As can be seen, given a previous construction 1, and a minimum investment, the system of the present invention would produce a light and reusable roofing 2 providing immediate benefits to the user, while using the previous technique would only produce the foundations, the owner then would have to wait several years in order to accumulate enough savings to complete the extension and obtain some benefit from the investment.

Figure 3:
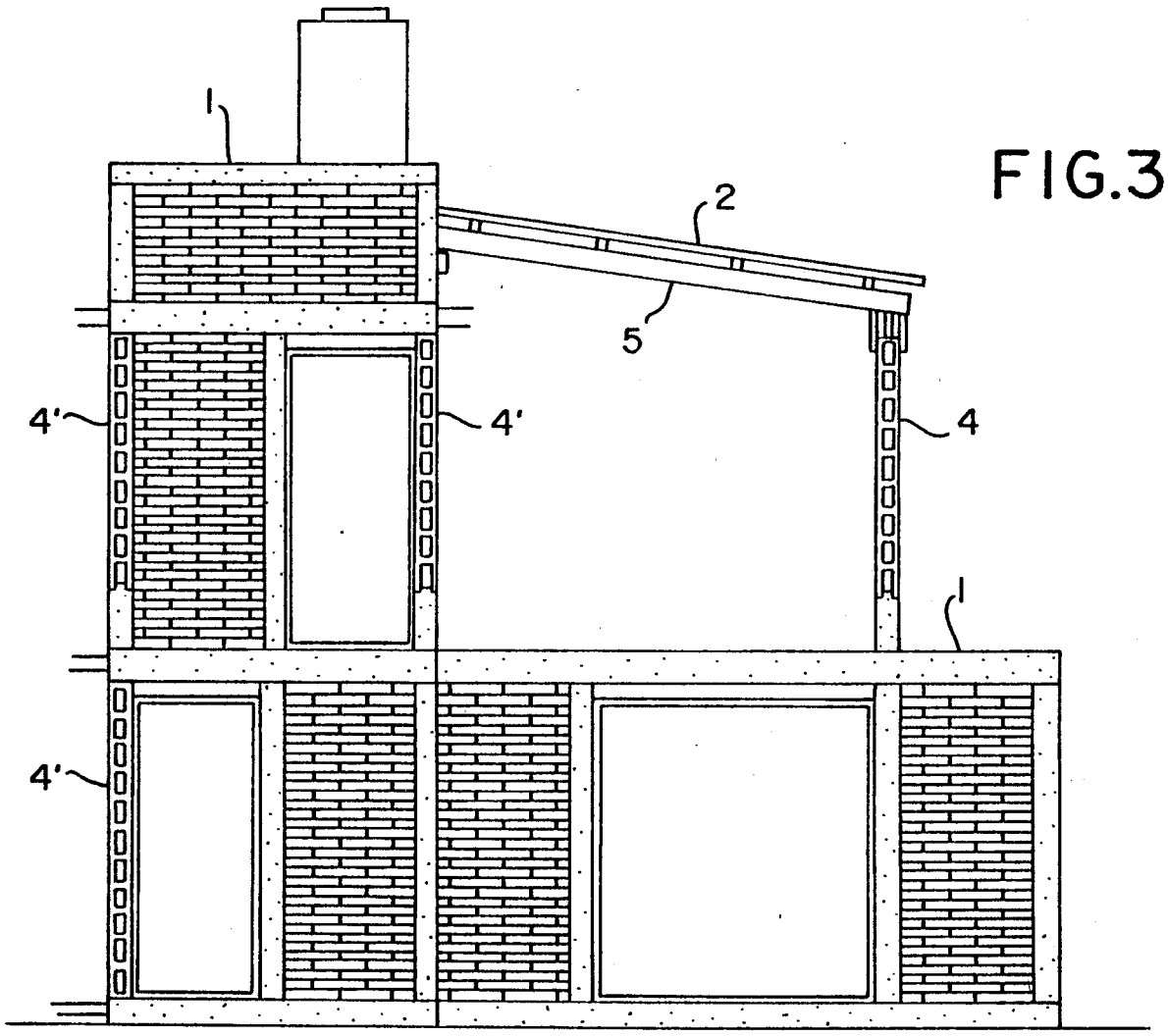
FIG. 3 is a front view of a construction and shows the first stage of an extension in an upper floor.

FIG. 3 illustrates the first stage of construction of an extension in an upper level of a previously built dwelling.

The extension will be built over a previously built portion 1, which preferently will have precast vertical wall reinforcements 4' where a connection of a future wall is expected. The initial precast vertical wall reinforcements 4 will be placed in the first stage, but only in the number required to support the structure of the temporary roofing 2 and the elements 5 which comprise it.

Figure 4:
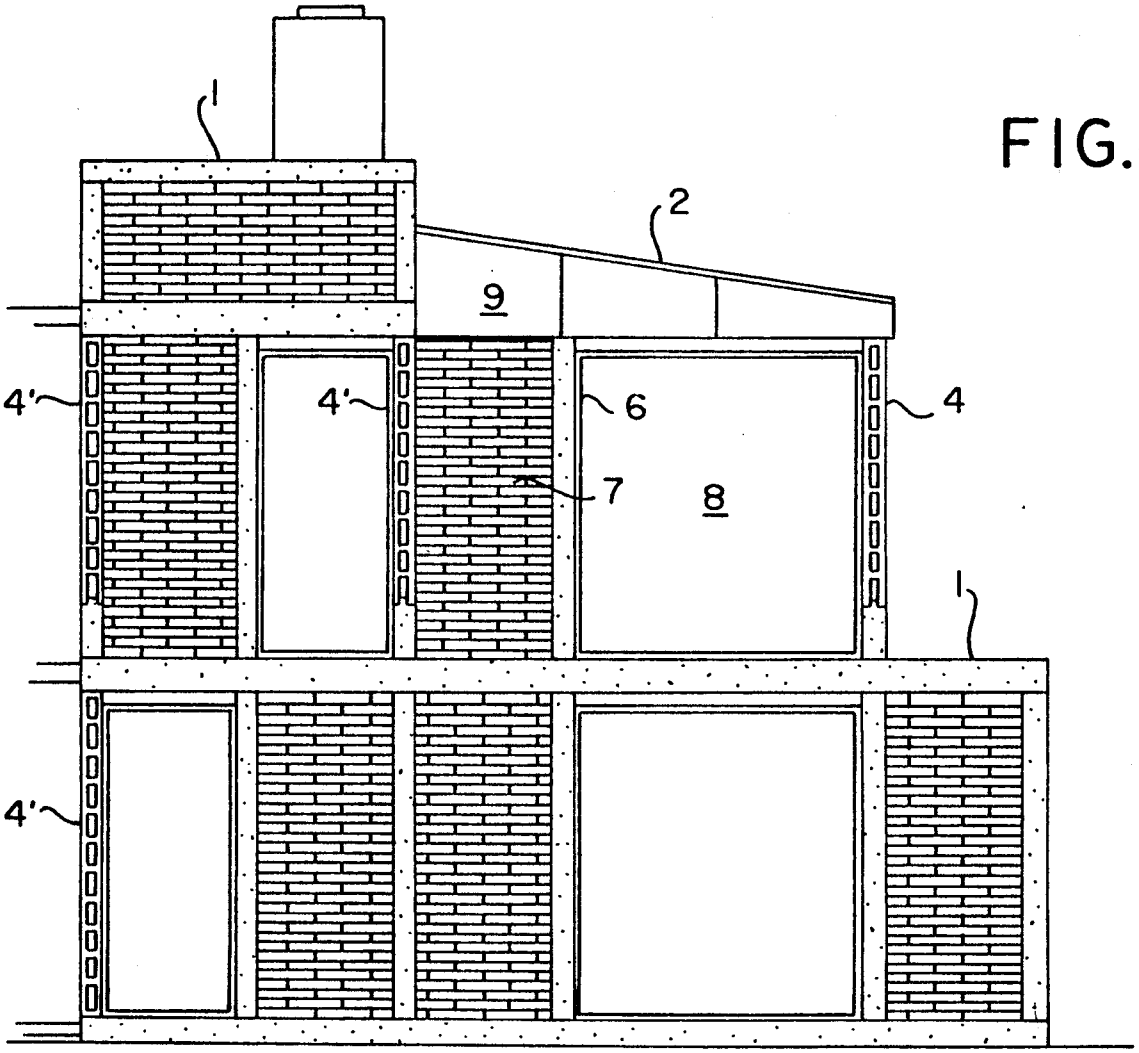
FIG. 4 is a front view of the construction shown in FIG. 3 illustrating the second stage of the same extension.

As shown in FIG. 4, in the second stage of construction, one may proceed to entirely enclose the space, by installing complementary precast vertical wall reinforcements 6 or by pouring these elements at the site as is conventionally done. Load bearing brickwork 7 would also be laid, the required windows and doors 8 would be installed and the wedges formed by the sloping roof 2 would be covered with roofing sheets 9.

Figure 5:
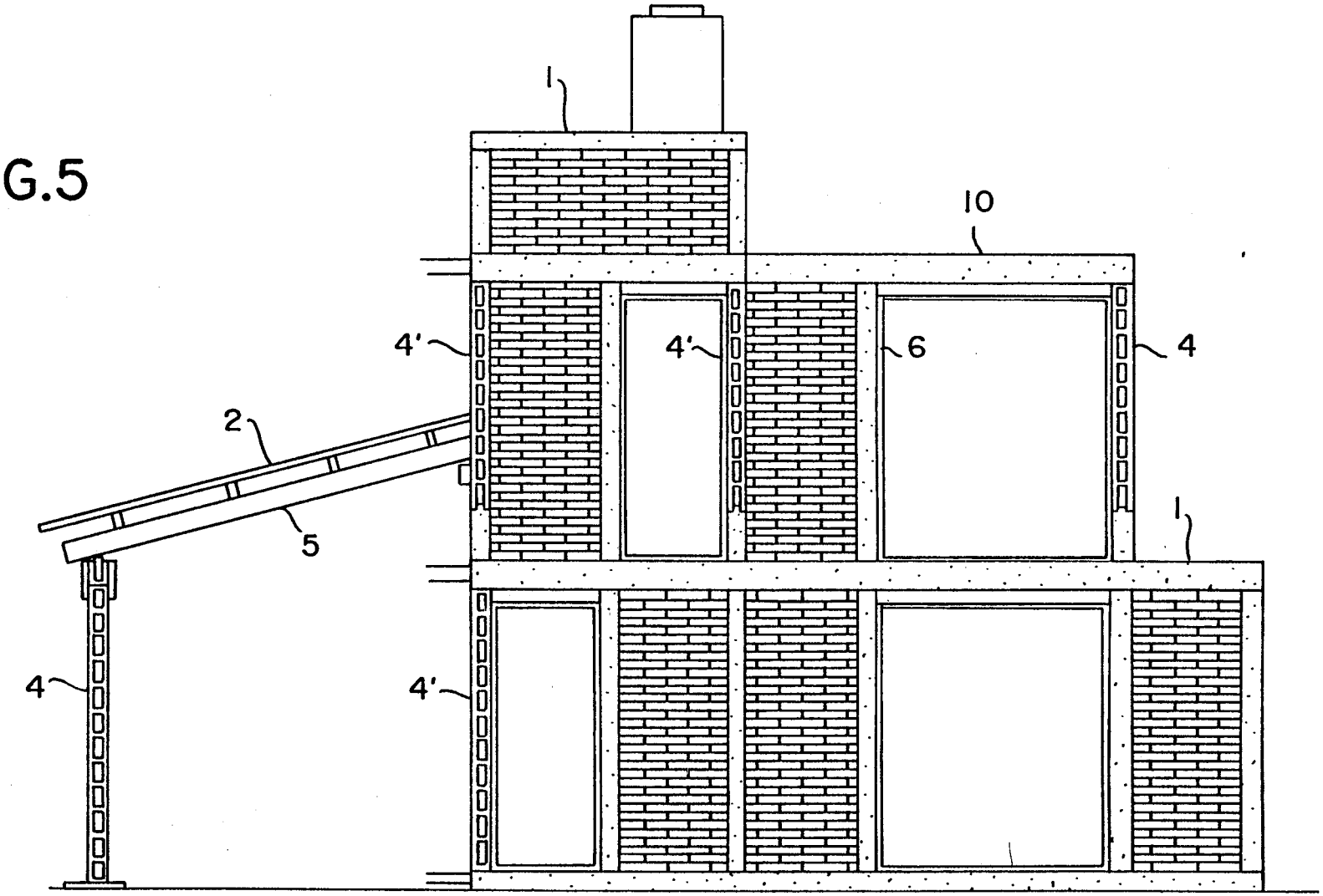
FIG. 5 is a front view of the construction shown in FIGS. 3 and 4 illustrating the placement of a permanent roofing and the termination of the extension in the upper floor. It also shows the initial stage of an extension on the ground floor.

In FIG. 5 the next stage of construction shows a properly finished extension with a slab 10. Here the final elements of the temporary roofing are removed to be installed in a new extension, that is the roofing 2 and the elements 5 forming its structure which will be described in detail later on. Once this is done one would proceed to build the final concrete slab 10 and finally the finishings and the internal partitions if so required.

The stages previously described are only one of the many possible alternatives of this system.

As a second prefered alternative in the second stage of construction the owner may enclose the space with provisional walls made from sheets and the walls so built could deteriorates and obstructs part of the site, while if placed undercover it will hinder and crowd the house, occupying scarce and valuable covered space.

The system of the present invention allows for the building of extensions without obstructing or interfering with former constructions and since the later portion of the extension can be built undercover the workers productivity will increase and the halting of work due to rain will be diminished.

Another advantage of the present invention is that extensions may consolidate through very small increments including the gradual construction of foundations. This will enable the installation of temporary walls instead of final ones, portion by portion, or side by side without dismounting the temporary roof.

One more advantage of the system of this invention is that it allows for a very gradual growth the construction and can be easily modified according to the needs and preferences of the owner without involving costly adaptations. The possibility of growth by small increments also provides diversity and individuality to the dwelling, since even if the same prototype is used each unit will distinguish itself according to its particular degree of development.

Another advantage of the present invention results from the way brickwork is joined to the vertical wall reinforcements. This joint as will be seen later on does not require the simultaneous construction of all the brickwork that concurrs to a given vertical reinforcement. Hence, load bearing walls can be built before non bearing walls are erected, and construction can follow a room by room sequence instead of a floor by floor procedure.

Yet another advantage is that the vertical reinforcements can be poured at the factory using a single mould and later, at the site, each unit can be adapted to serve under different circumstances as would be different heights, different lateral, top and bottom connections to a variety of structural and constructive elements such as: walls, beams, joists, doors and windows.

Another advantage results from placing the vertical reinforcements before the brickwork is laid. With this procedure each layer of brick is connected and secured to the vertical reinforcement, avoiding the danger posed by the temporary instability of the brickwork, furthermore, when construction is done above ground level the vertical reinforcements can be used to support temporary protective hand rails.

These as well as other objectives and advantages of the present invention are at least partly understood and others will become clear following review of the description and the illustrations of the invention. In a later stage be substituted one by one with final load bearing walls.

Figure 6:
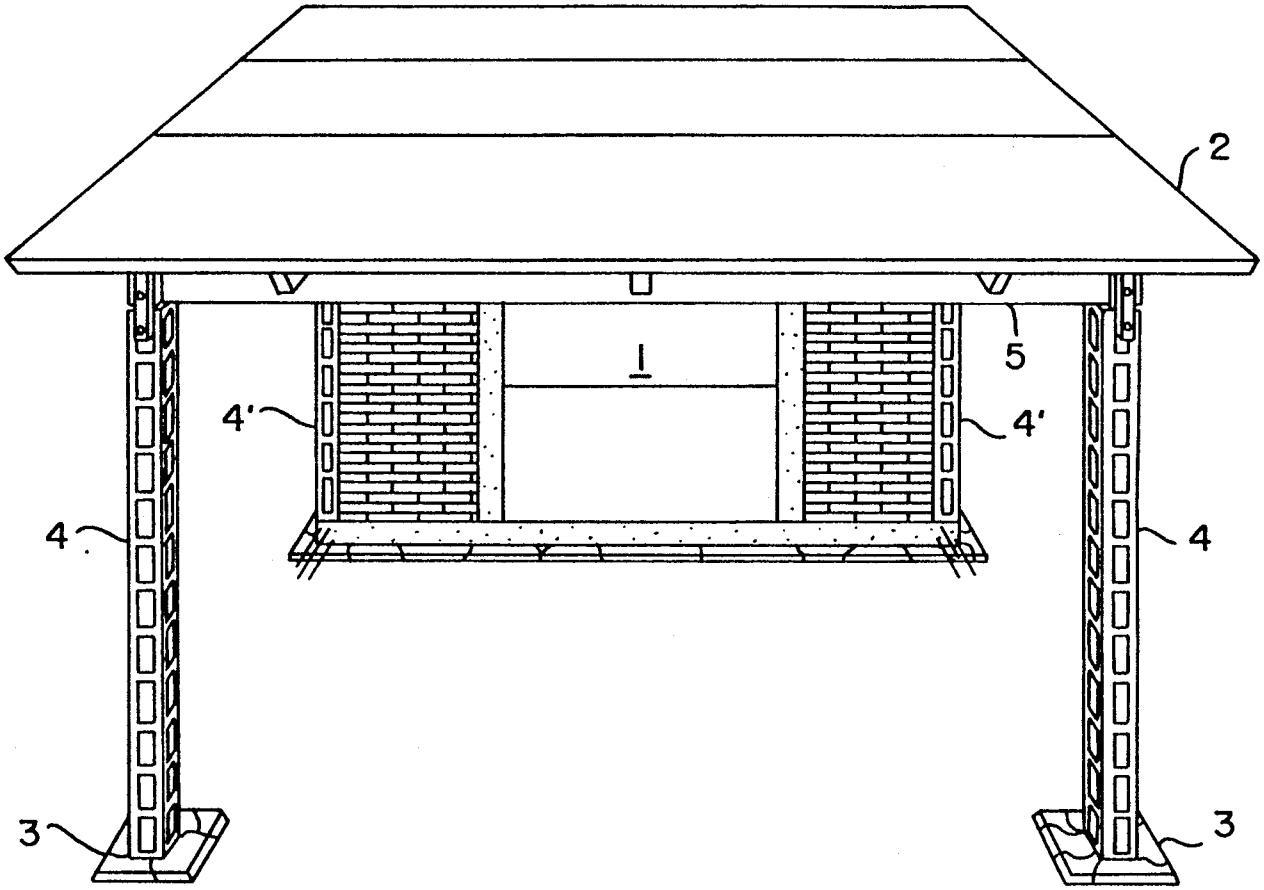
FIG. 6 is a perspective view showing the termination of the initial stage in the construction of an extension at ground level.
Figure 7:
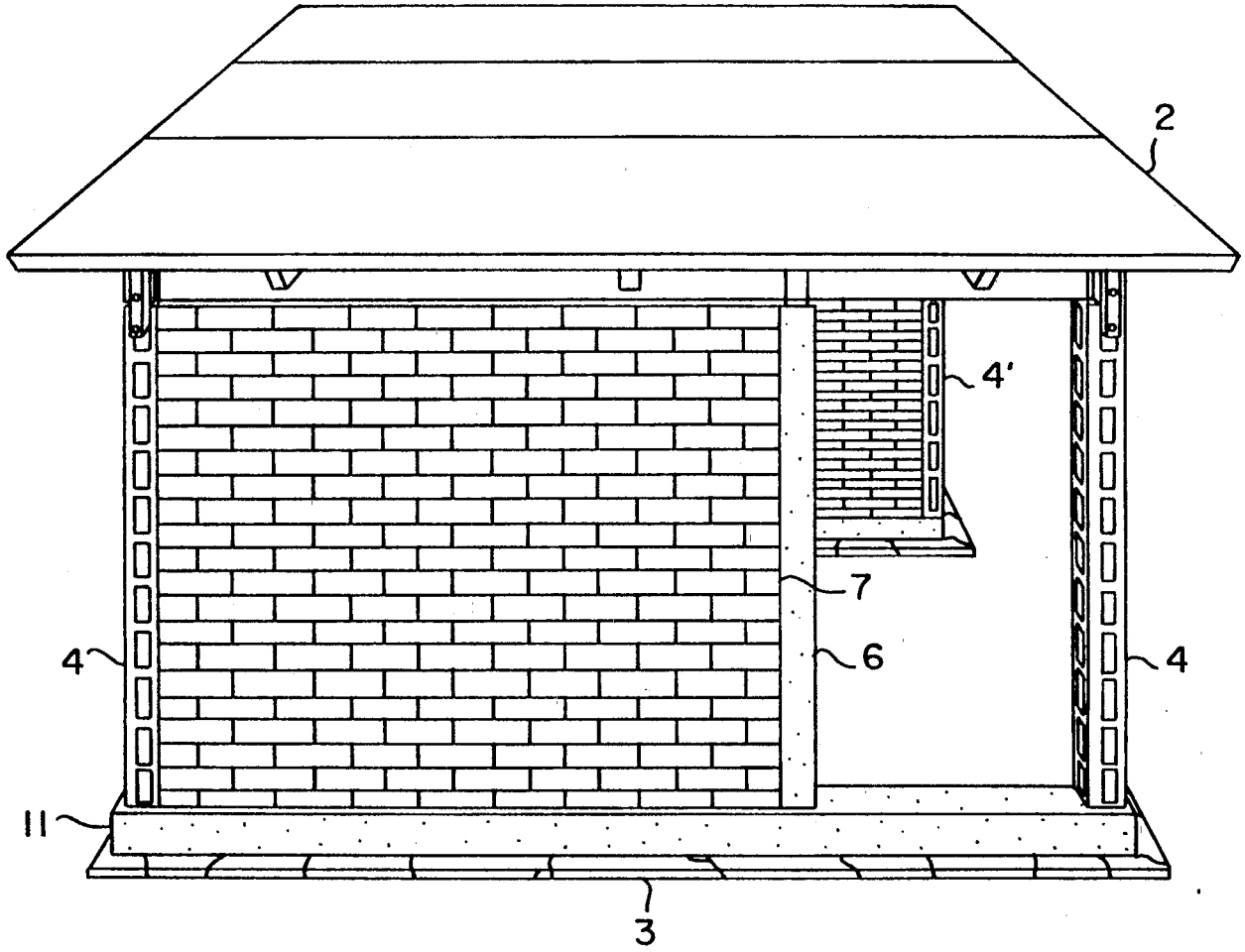
FIG. 7 is a perspective view showing the side by side development of foundations, complementary vertical wall reinforcements and brickwork.

To illustrate this type of growth FIGS. 6 and 7 show the construction of an extension on a ground floor.

The system is basically the same as the one previously described, its objective being that of consolidating a re-usable roof in the first stage of construction as shown in FIG. 6. This will require partial foundations 3 to support the initial precast vertical wall reinforcements 4 to be placed according to a pre-established geometry of the extension, and which will support a wood or steel dismountable structure 5 to which the roof 2 is attatched.

FIG. 7 shows a second stage in which the foundations 3, the horizontal reinforcement 11, the brickwork 7, and the complementary vertical wall reinforcement 6 of a single side of the extension are built.

In this manner and following the system of the present invention the construction can follow a multidirectional order minimizing idle investment, since, from the very beginning, foundations and vertical wall reinforcements are partially built and a temporary roofing is installed. As time goes by the building will be completed with the speed and direction that correspond to the income and preferences of the owner.

Figure 8:
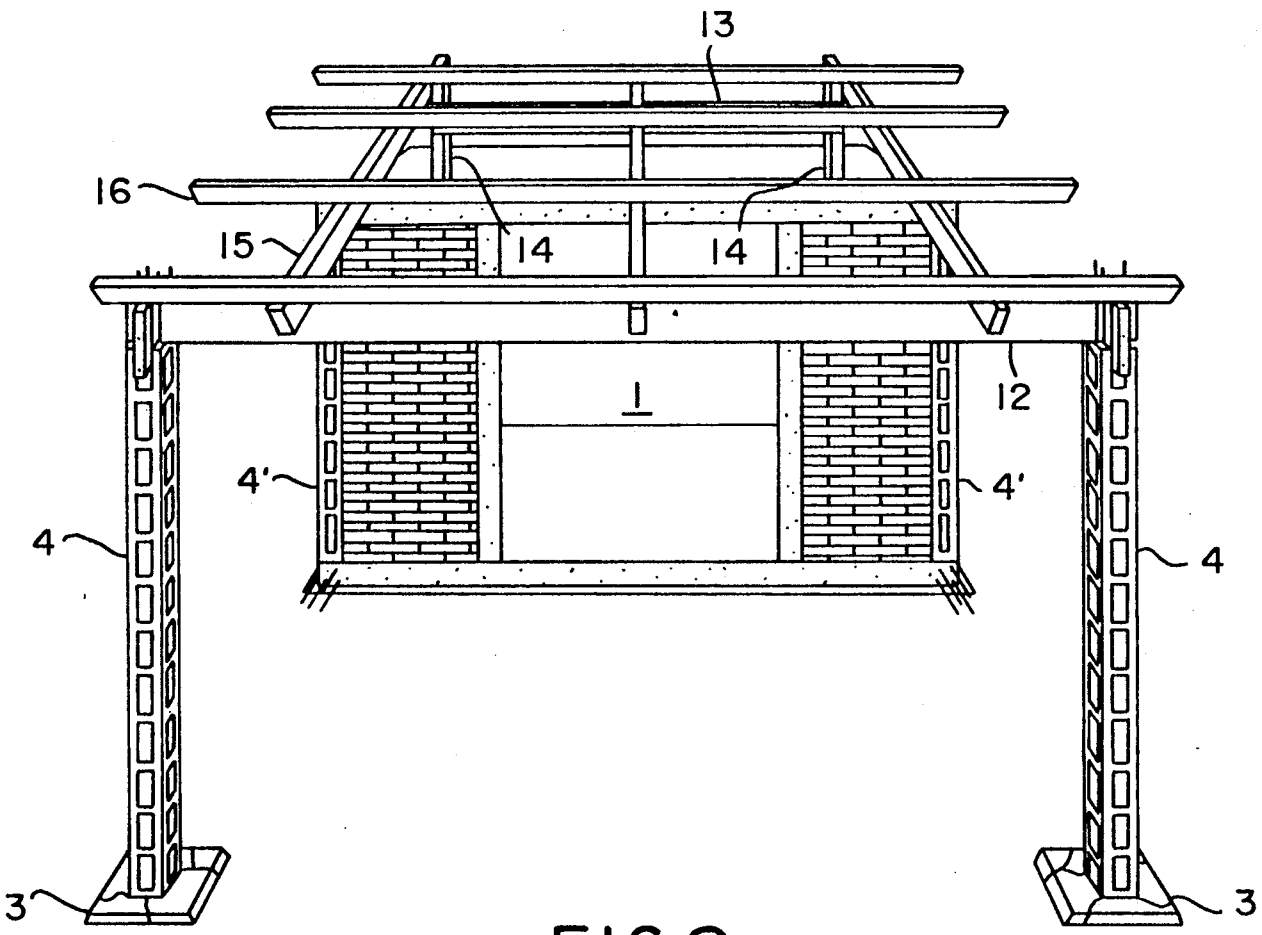
FIG. 8 is a perspective view of the structure that supports the temporary roofing.

FIG. 8 shows the structure which supports the temporary roofing. It consists of a main girder 12 resting upon precast vertical wall reinforcements 4. Parallel to the main girder in the back side of the extension and at a higher point, another secondary girder 13 bears on a pair of receptors 14 which are firmly connected to the previous construction 1. Following this and resting on both girders are a series of rafters 15 supporting a series of minor beams 16, which in turn receive the load from the elements forming the roof. It is worth noting that when using structural roofing elements of large span, rafters and minor beams can be spared.

As mentioned before one of the constituents of the system are the precast vertical wall reinforcements that support the structure of the temporary roofing and that differ from those of the traditional system in that they are installed before the brickwork is laid. This change of order allows for the in-factory pouring of the reinforcements that will later be installed at the building site.

The precast vertical wall reinforcements are concrete elements reinforced with four longitudinal steel bars 17 and transverse steel 18 as shown by FIGS. 9-31. As a distinguishing feature, a series of adjacent indentations of considerable depth are arranged on each of the four sides of the element. As will be described later, this arrangement together with the mobility of the precast element allows for its easy adaptation to diverse conditions, and the accomplishment of multiple functions not necessarily related to the conventional progressive construction of dwellings.

Figure 9:
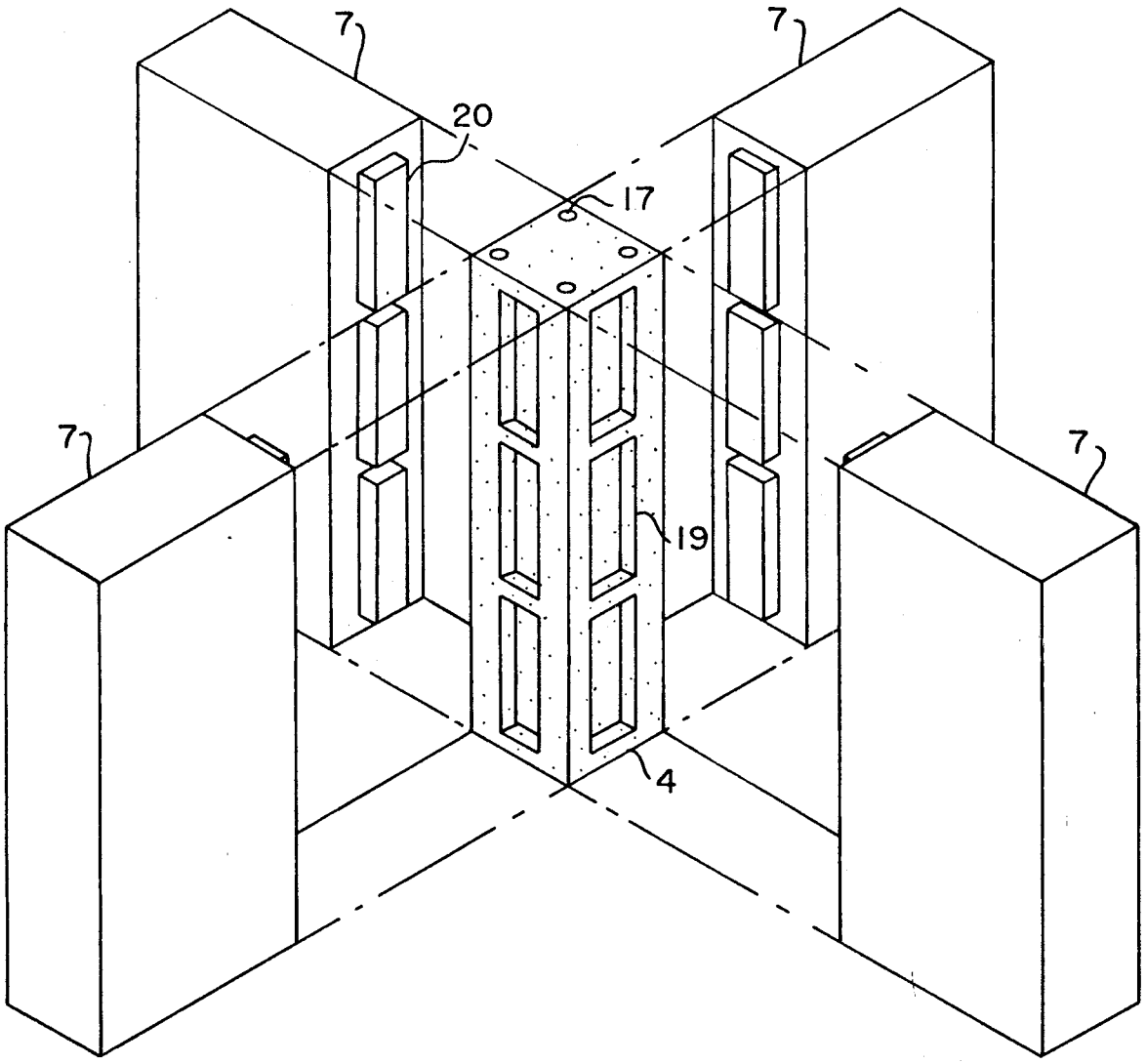
FIG. 9 is an isometric view showing the connection principle between 4 walls and a vertical wall reinforcement.
Figure 10:
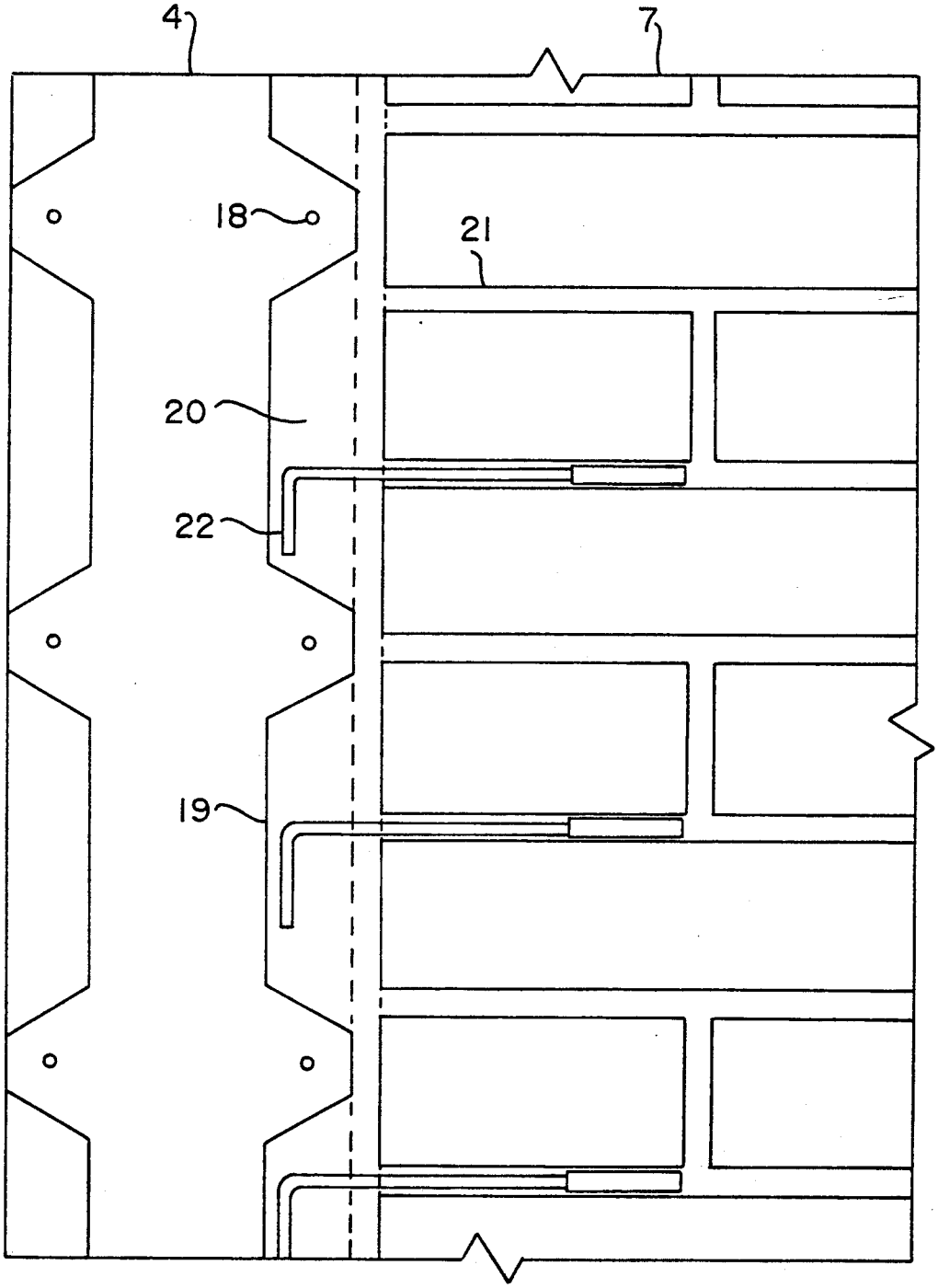
FIG. 10 is a longitudinal section showing the reinforced connection between the brickwork and the precast vertical wall reinforcement.

The connection principle between a segment of a precast vertical wall reinforcement 4 and four concurrent walls 7 is shown in FIG. 9. Here the indentation 19 of the precast vertical wall reinforcements are filled with mortar keys 20 that protrude from the wall. This arrangement forms a connection resistant to shear in the plane of the wall and in a perpendicular direction to it. This connection can be reinforced by interconnecting bent steel reinforcements or reinforcing members such as bars 22 in the horizontal mortar joints of the brickwork 21 as shown in FIG. 10.

Figure 11A:
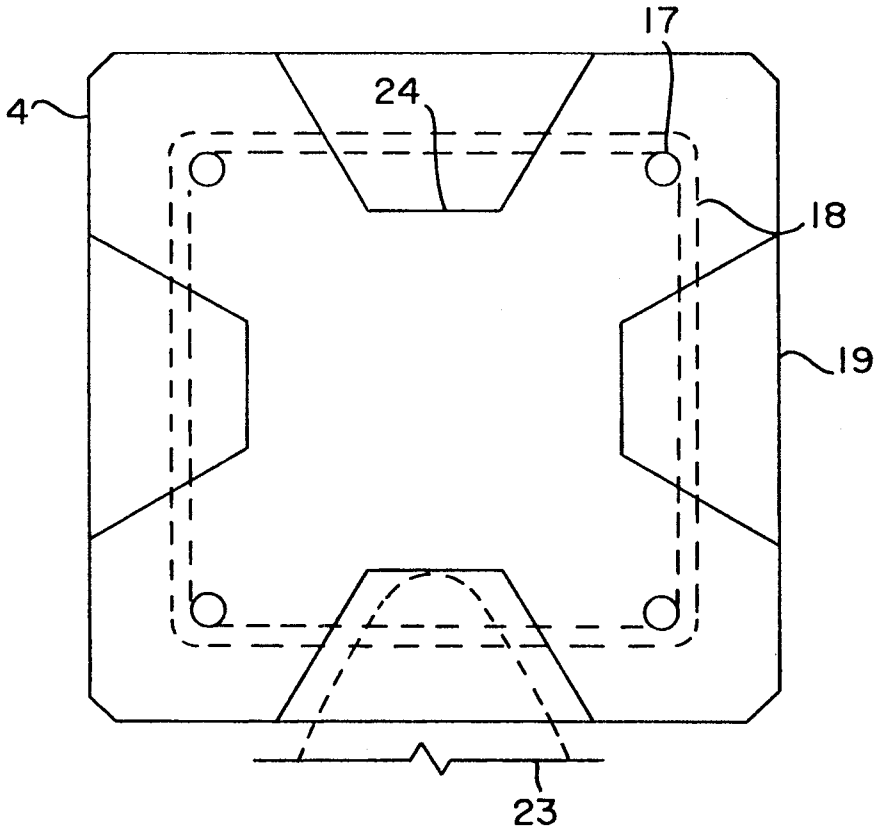
FIG. 11A is a transverse section of a precast vertical wall reinforcement with trapezoid indentations.

In a transverse section the indentations of the precast vertical wall reinforcement can be trapezoidal in shape as shown in FIG. 11 semicircular or rectangular, but always allowing easy access by a masons pointing trowel 23 as shown by dot-dash line in FIG. 11. The indentations limit a core 24 free from steel since they are placed along the rectangles formed by the longitudinal 17 and transverse 18 bars. As may be observed the depth of the cells 19 can exceed the planes defined by the steel reinforcement without reducing the appropiate covering of the bars.

Figure 11B:
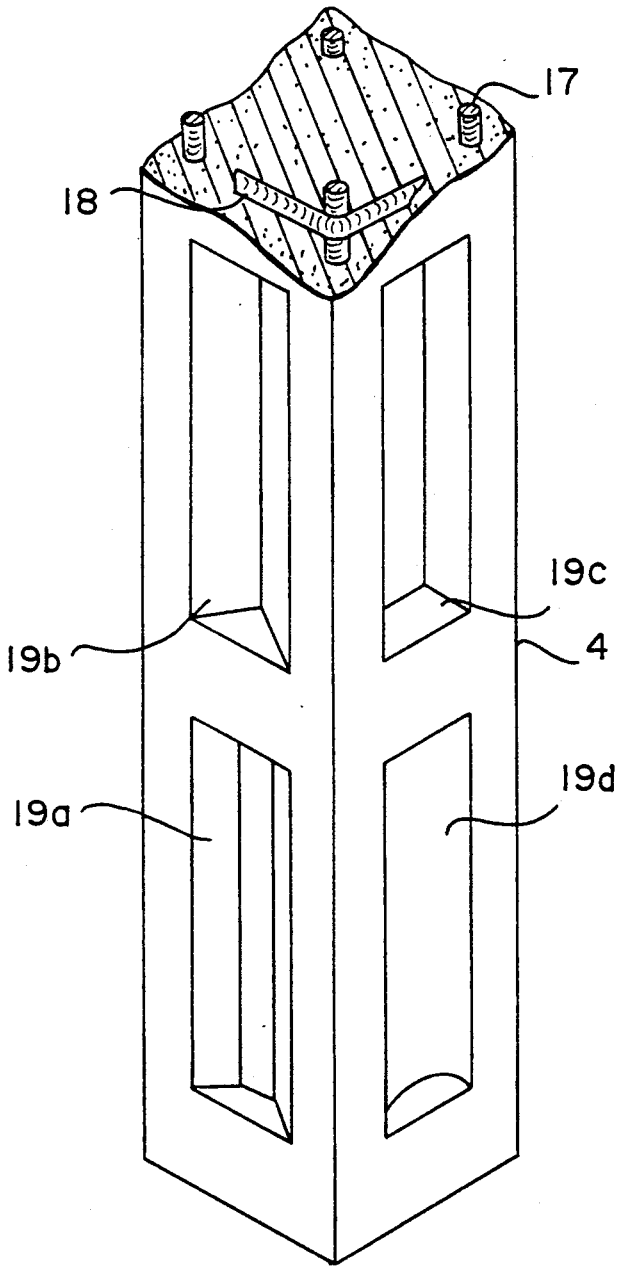
FIG. 11B is a partially cut away view of a precast vertical wall reinforcement showing various shapes of indentation cross sections.

FIG. 11B shows a precast vertical wall reinforcement 4 of rectangular cross-section. Two planar outer surfaces with indentations having cross section shapes that are trapezoidal (19*a*), triangular (19*b*), rectangular (19*c*) and semi-circular (19*d*), are shown. Two rear planar surfaces not visible in this figure may have similar indentations therein.

As will be described later, the indentations: provide the means to connect the brickwork, and reduce the weight of the element and enable its adaptation to different circumstances. This multifunctional characteristic justifies the use of only one mold in the production of all the precast vertical wall reinforcements placing indentations along their length and on their four sides. Thus, at the building site, each indentation can be easily activated or cancelled according to specific requirements.

In order to connect the precast vertical wall reinforcement to the structure, its longitudinal steel bars can project beyond the concrete in its upper and lower portion, and to facilitate mounting operations each element can have a piece of steel pipe in the lower portion of the concrete.

At the building site the mobility of the precast vertical wall reinforcement facilitates the preparations done on it since it can be stored in an area with electricity and worked in a horizontal position.

Figure 13:
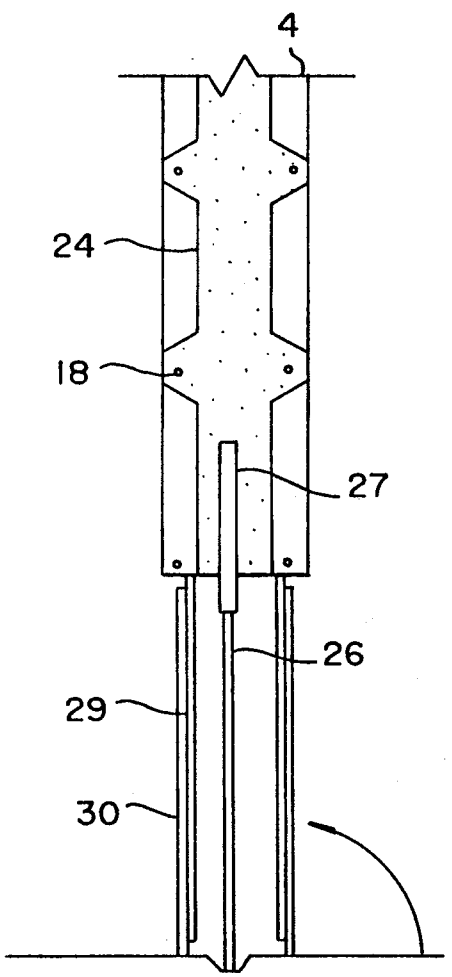
FIG. 13 is a front view showing the mounting of a precast vertical wall reinforcement supported by a steel bar.
Figure 12:
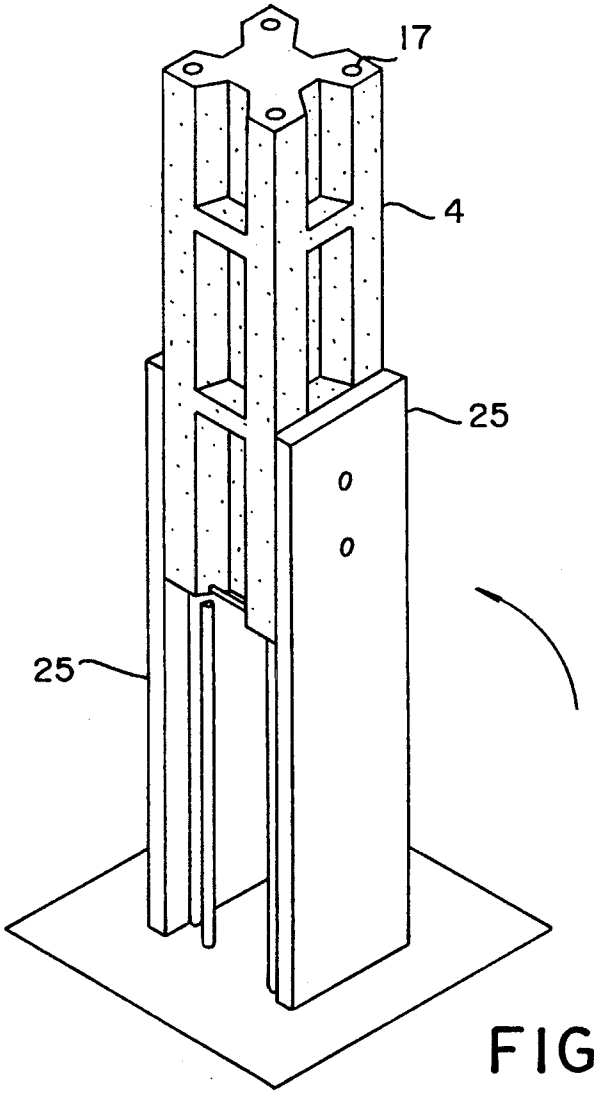
FIG. 12 is an isometric view showing the mounting of a precast vertical wall reinforcement supported by the connections formwork.
Figure 14:
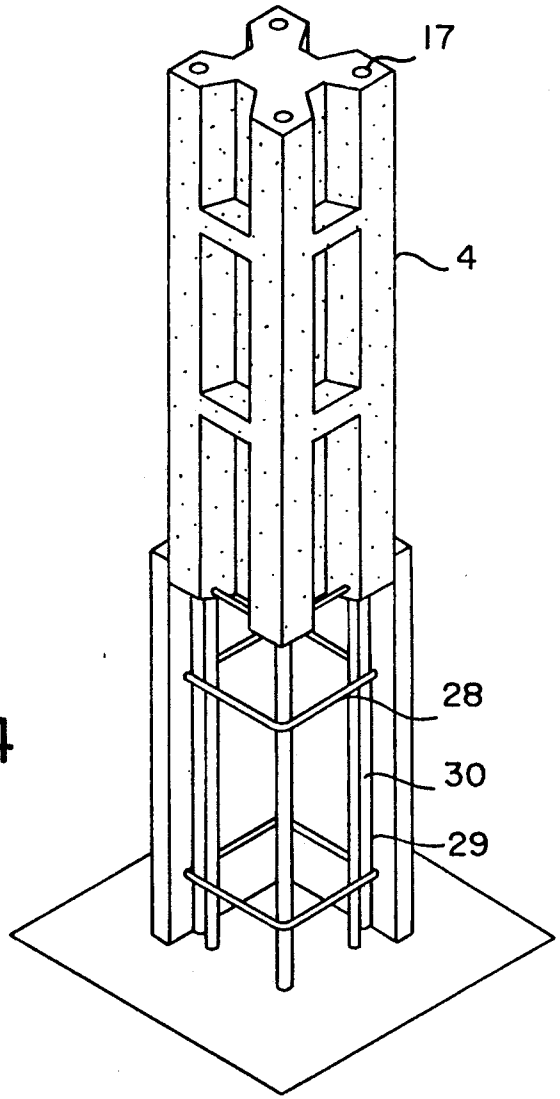
FIG. 14 is an isometric view showing the steel bar arrangement of the connection of a precast vertical wall reinforcement installed on a surface.

Once the precast vertical wall reinforcement has been adapted to perform its specific functions it can be easily moved by two workmen to the place where it will be mounted. There, it may be placed horizontally and two of its four sides will be fixed to the formwork 25 that forms the connection shown in FIG. 12. Another mounting alternative uses the mounting steel pipe 27 to insert a steel bar 26 as shown in FIG. 13. Later it will be erected with a rotating motion until it reaches the vertical position. Once in the vertical position the element will be laterally supported and properly plumbed, the transverse steel 28 of a connection will be placed around the projecting longitudinal bars 29 of the element 4 and those anchored at the site 30, as shown in FIG. 14. Finally the formwork of the connection will be completed and the concrete poured.

This method of installation is advantageous since it does not require special mounting equipment and the height of the precast element can be controlled with the formwork or with the length of the steel bar inserted into the mounting pipe.

Figure 15:
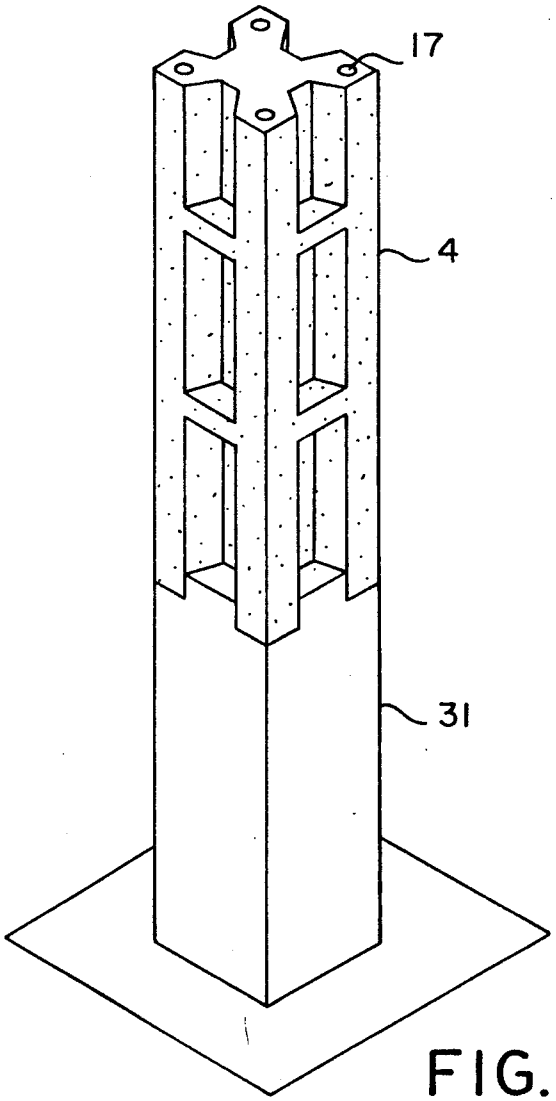
FIG. 15 is an isometric view showing a finished connection which has the same section as the precast vertical wall reinforcement.

FIG. 15 shows a finished connection 31 with the same section as the precast vertical wall reinforcement. In this case the concrete of the connection 31 would be poured in two stages. In the first one the larger part of the connection would be poured through a window set on one side of the formwork. Following this, the window would be closed and one of the four bottom cells would be used to complete the pouring while the other three could be used to verify the filling of the connection.

Figure 17:
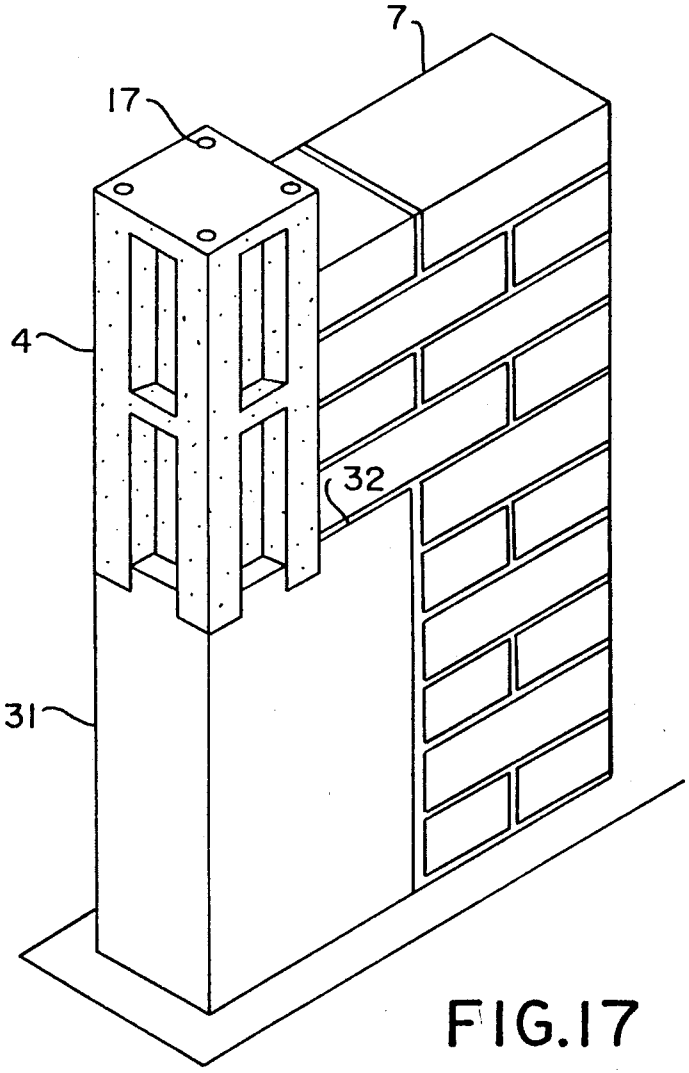
FIG. 17 is an isometric view illustrating how the extended connection illustrated in FIG. 16 becomes part of the brickwork in a later stage.
Figure 16:
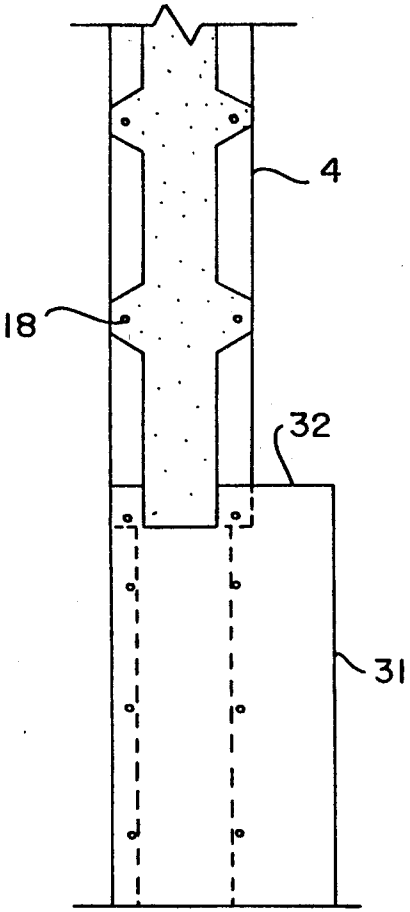
FIG. 16 is a longitudinal section showing an extended connection of a precast vertical wall reinforcement.

FIG. 16 shows an extended connection. This alternative uses the extended part 32 to facilitate the pouring of the connection, and later, the extended part can form part of the brickwork on one of its sides, as shown in FIG. 17.

Figure 19:
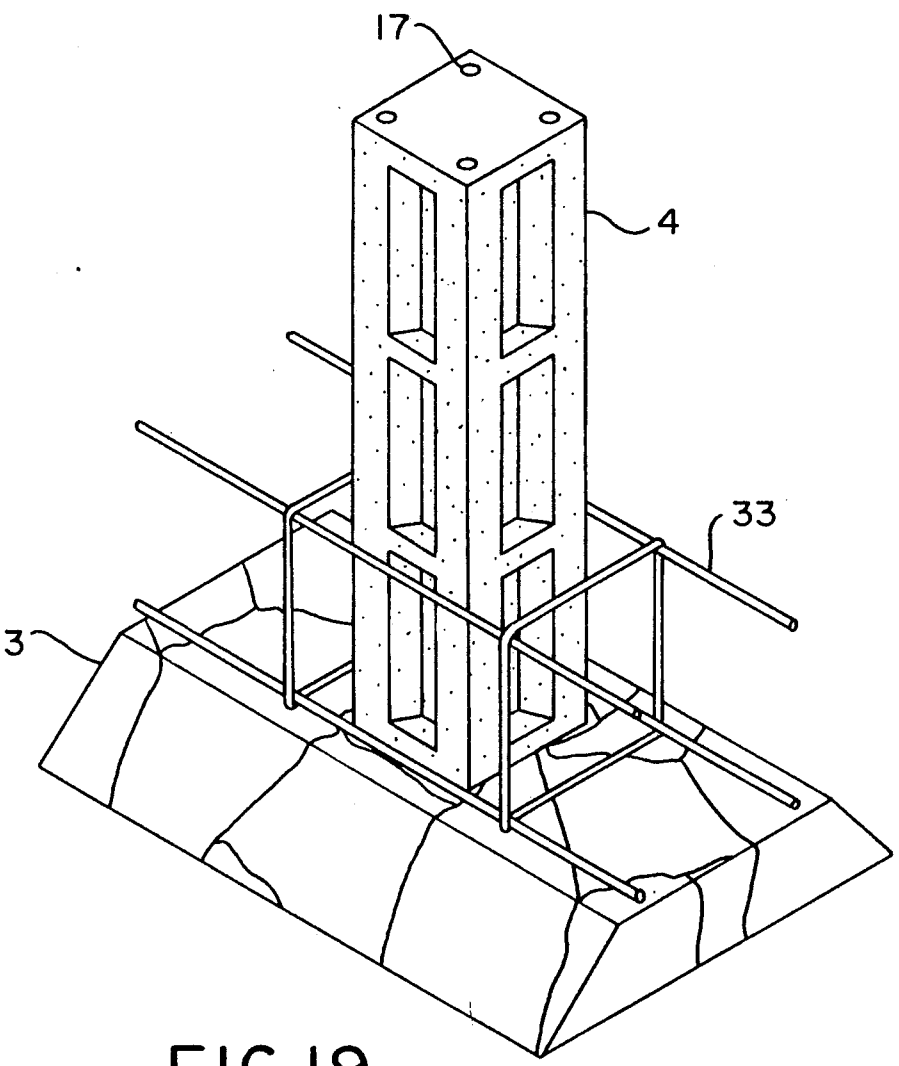
FIG. 19 is an isometric view showing an arrangement of a steel reinforcement for a horizontal reinforced concrete element provided to a previously installed precast vertical wall reinforcement.
Figure 18:
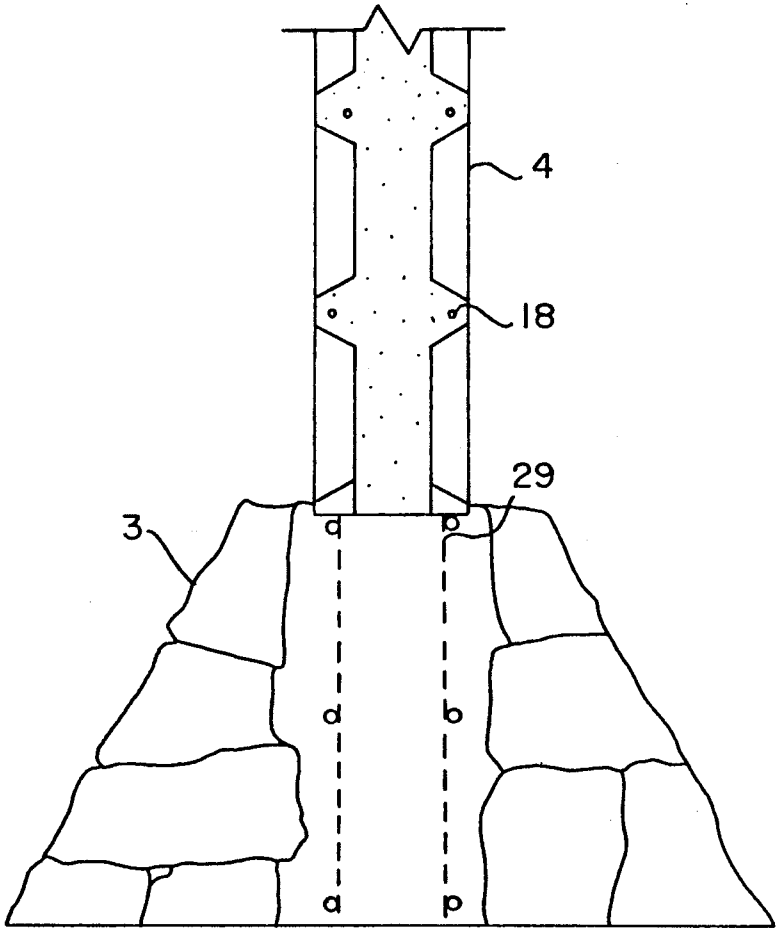
FIG. 18 is a longitudinal section showing the connection between a precast vertical wall reinforcement and the foundations.

FIG. 18 shows a direct connection between a precast vertical wall reinforcement 4 and the foundations 3. In this case as usual, the foundations form the formwork of the connection. This type of connection is specially important to progresively built constructions since a minimum investment enables the instalation of the precast vertical wall reinforcements and a temporary roofing even before the horizontal reinforcement of the foundation is built, which in this case can be poured at a later stage by placing longitudinal bars 33 on each side of the precast vertical wall reinforcement as shown in FIG. 19.

Figure 20:
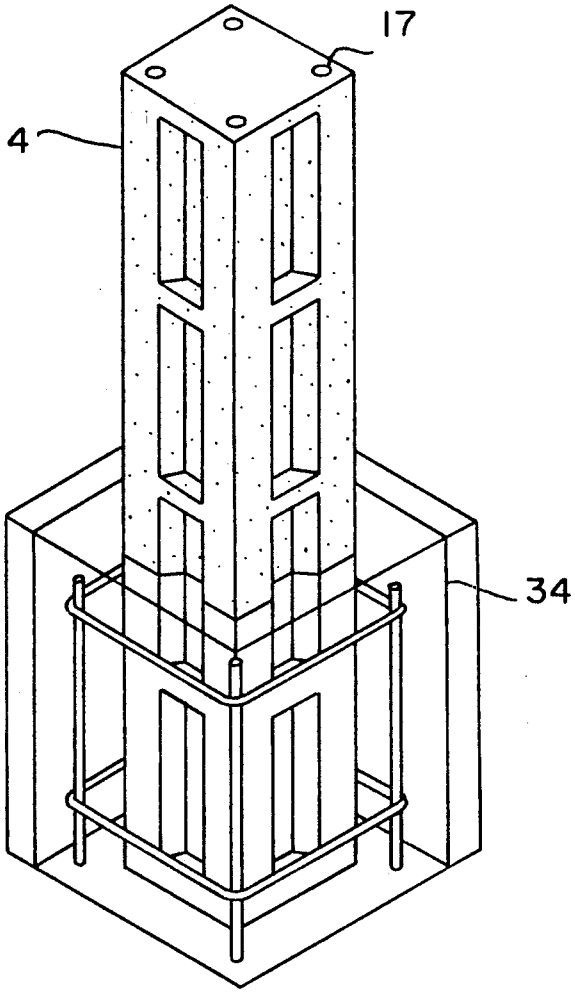
FIG. 20 is an isometric view showing the connection between a precast vertical wall reinforcement and a block poured at the site.

FIG. 20 shows another possible connection of the precast vertical wall reinforcement. Here the precast element bears directly on a surface and a reinforced and anchored concrete block 34 is later poured. In this case the indentations immersed within the concrete block forms a connection resistant to pulling and bending actions.

Figure 21:
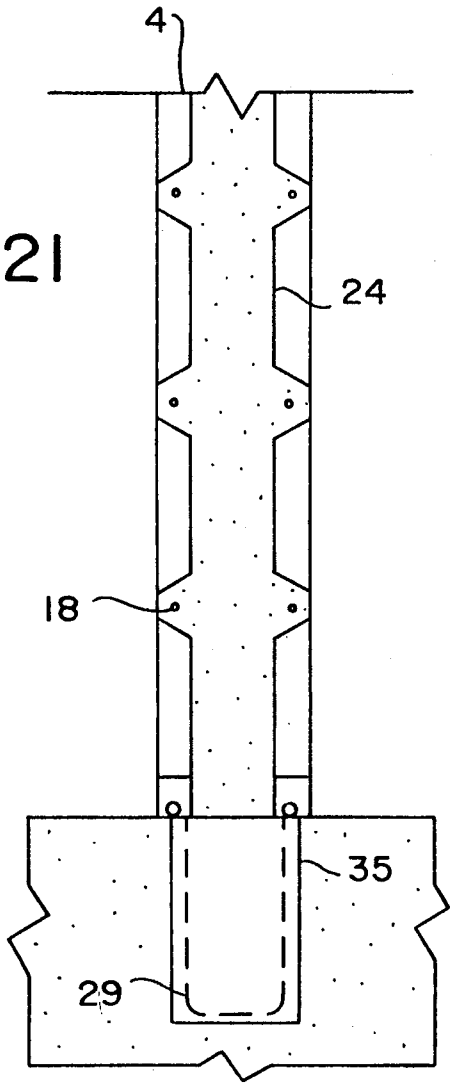
FIG. 21 is a longitudinal section showing the connection between a precast vertical wall reinforcement inside a block previously formed.

FIG. 21 shows how a precast vertical wall reinforcement can be connected to a previously formed block 35. In this case the block is filled with concrete and the precast element is placed supported on the border with its steel bars 29 firmly anchored within the block.

Figure 22:
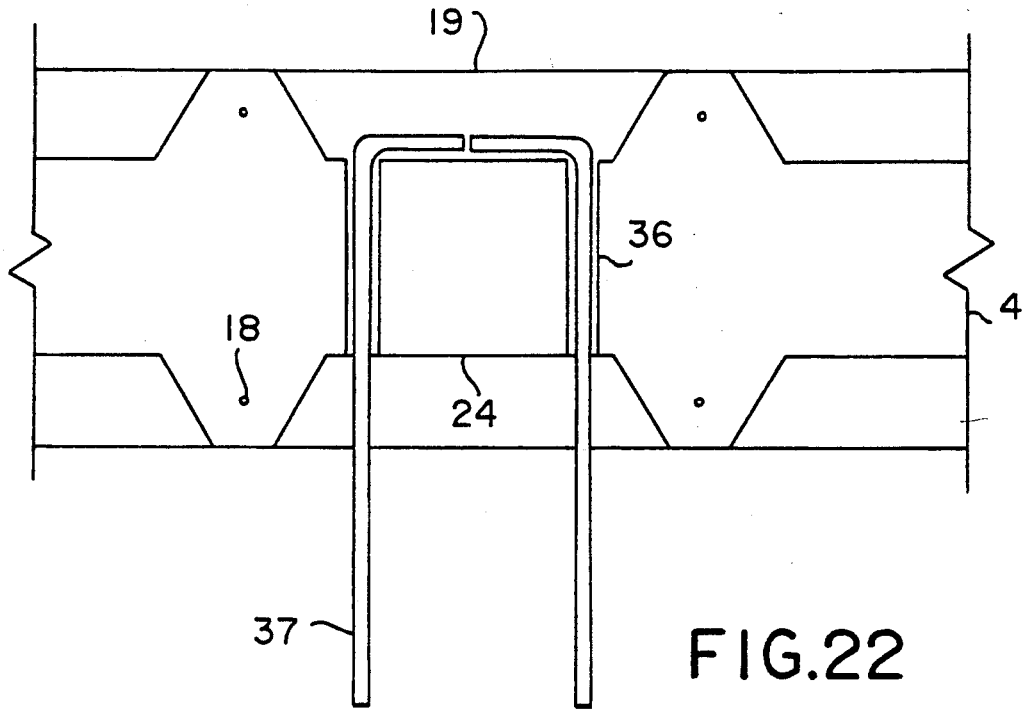
FIG. 22 is a longitudinal section showing how to arrange steel bars to form a horizontal connection resistant to bending and extraction.
Figure 23:
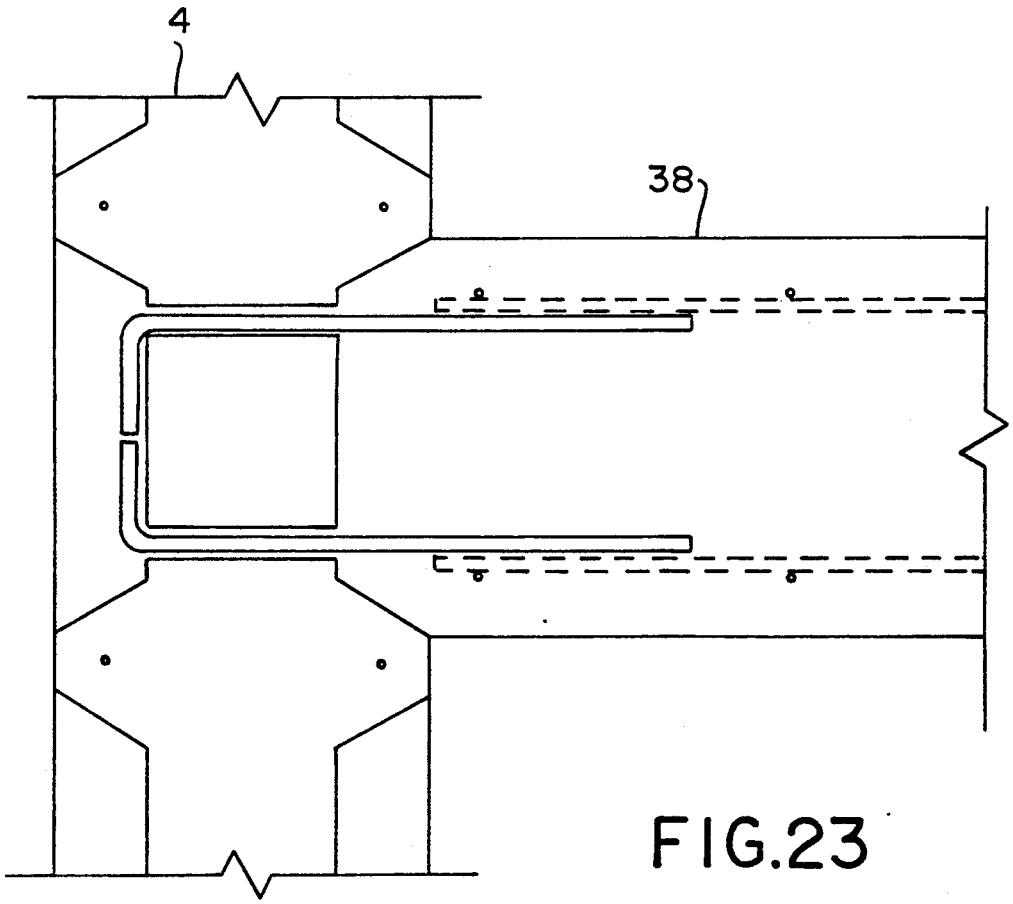
FIG. 23 is a longitudinal section showing the connection between a precast vertical wall reinforcement and a horizontal reinforced concrete element.

As has been previously mentioned, the deep indentation on the sides of the precast element allow for its adaptation to different circumstances. One such adaptation is shown in FIG. 22 which illustrates the preparation to join a precast vertical wall reinforcement to a horizontal reinforced concrete element like a lintel or a window sill. As can be seen, with the use of a conventional drill holes 36 are perforated through the core 24 of the precast element 4 at a preestablished indentation. This is easily performed since the depth of the indentations considerably reduces the depth of the core. Next, two steel bars 37 bent at 90 are introduced through the holes and concrete is poured in the upper indentations 19 completely covering and anchoring the steel bars 37. This preparation can be easily accomplished with the precast element being in a horizontal position. Once the preparation has hardened, the precast element can be installed and later joined to the horizontal element 38 as shown by FIG. 23.

Figure 25:
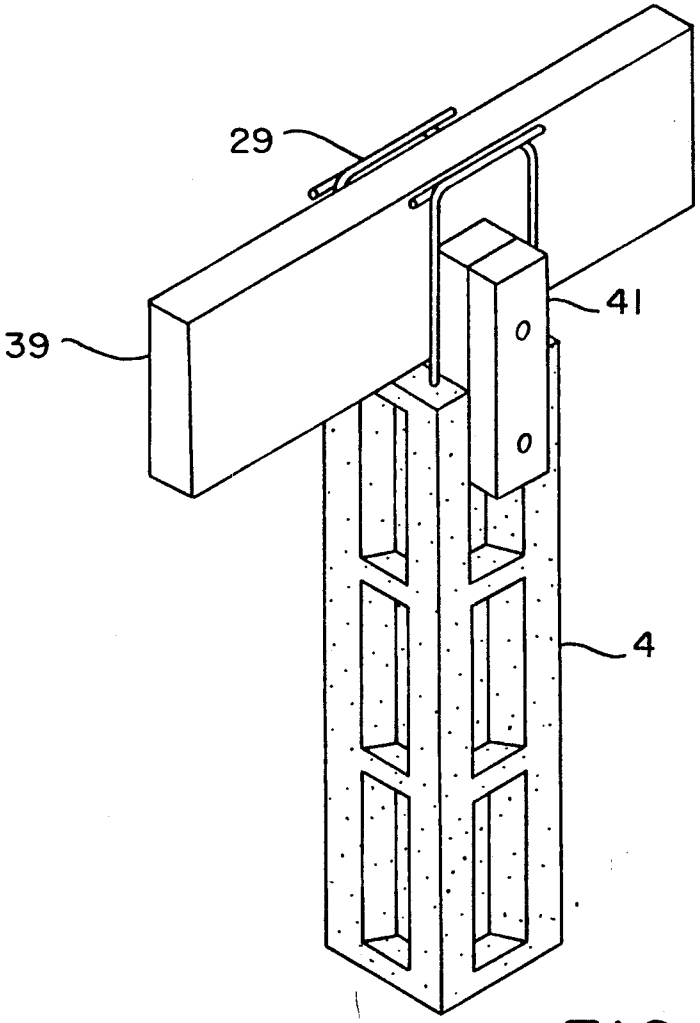
FIG. 25 is an isometric view of the connection shown in FIG. 24.
Figure 24:
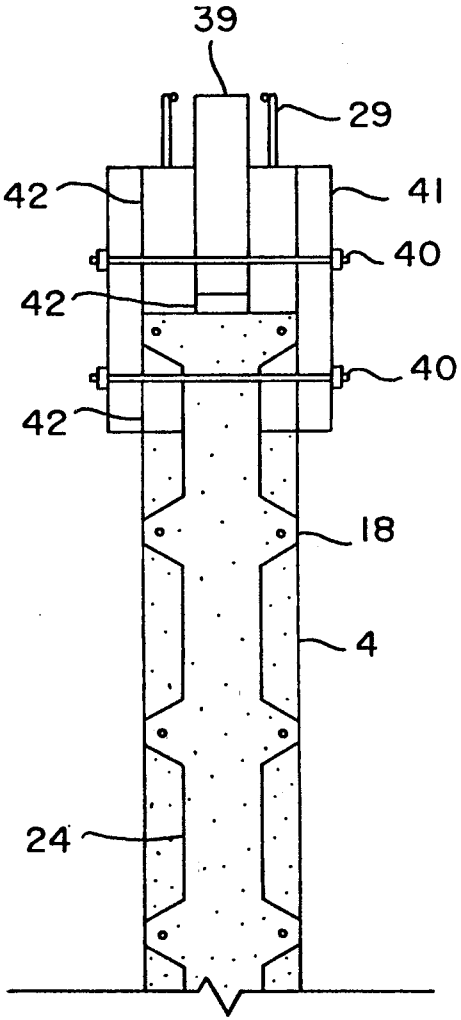
FIG. 24 is a longitudinal section showing how a wood beam is joined to the upper part of a precast vertical wall reinforcement.

FIG. 24 shows how a wood beam 39 can be connected to the upper part of a precast vertical wall reinforcement. In this case the connection is accomplished by drilling a hole in the upper part of the upper indentation in a perpendicular direction to the beam. Next, using a bolt 40, wood laterals 41 and fillings 42 are joined to both sides of the precast element. Finally the top fillings and the beam are attached to the laterals by way of a second through bolt. With this connection the precast element retains its upper steel prolongations 29 as shown in FIG. 25. Thus whenever it is required the beam and the connection can be disassembled and the precast element's upper part can be joined to a final construction.

Figure 26:
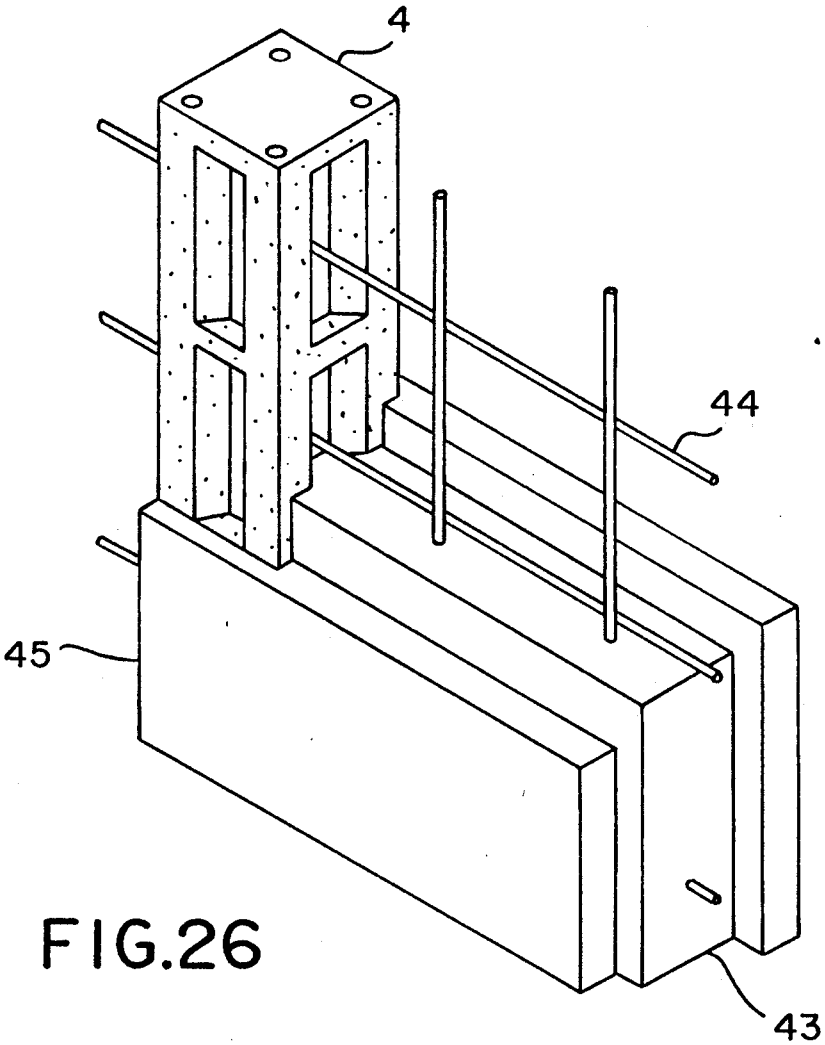
FIG. 26 is an isometric view showing the connection between a reinforced concrete wall and a precast vertical wall reinforcement.

FIG. 26 shows the connecting method between a precast vertical wall reinforcement and a reinforced concrete wall 43. Here the precast element is prepared by drilling a series of holes through its core. The holes are then used to pass through the horizontal steel reinforcement 44 of the wall. In this case the precast element can also be used to separate and align the formwork 45 for the wall 43. In case the wall ends at the precast element, a preparation like the one shown in FIG. 22 can be provided on several of the indentations.

Figure 27:
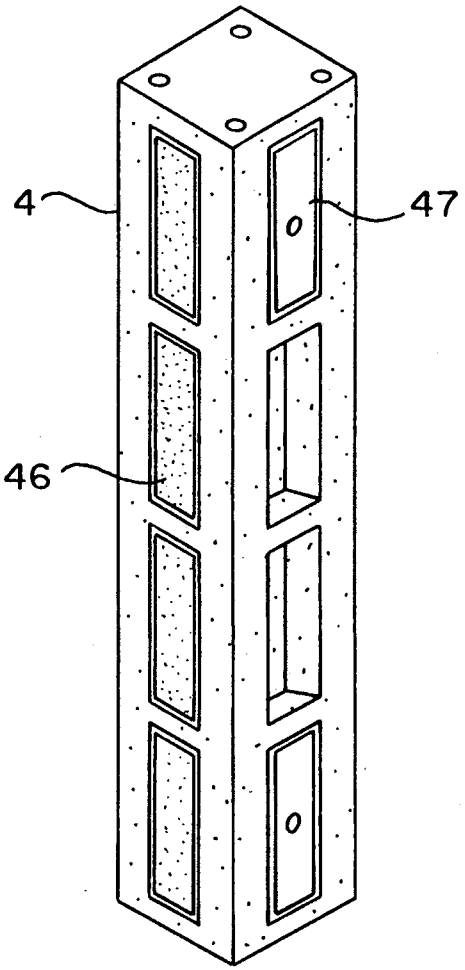
FIG. 27 is an isometric view showing the placement of wood blocks in the indentations of a precast vertical wall reinforcement and the filling of these.

When the indentation in the precast element present an inconvenience or are simply not used they can be easily eliminated by filling them with a concrete or mortar mix 46 as shown by FIG. 27. This can be easily done when the precast element is in a horizontal position. The cells can also be used to place wooden blocks 47 to which doors windows and other accesories can be easily fixed. Still other inlays can be installed for the purpose of enhancing the appearance of the precast element.

As can be seen the mobility of the precast element and the ease with which its core can be drilled combined with the possibility of filling its indentation enables the still other multiple connections like the ones shown in FIGS. 28 through 31.

Figure 29:
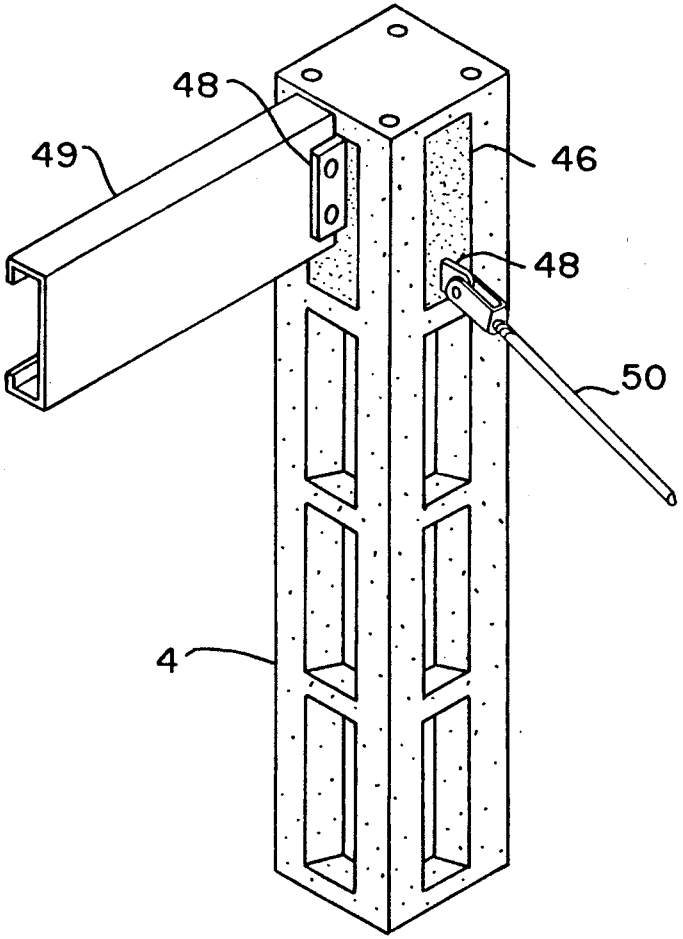
FIG. 29 is an isometric view showing one method of connecting a steel beam and a tightener to the indentations of a precast vertical wall reinforcement.
Figure 28:
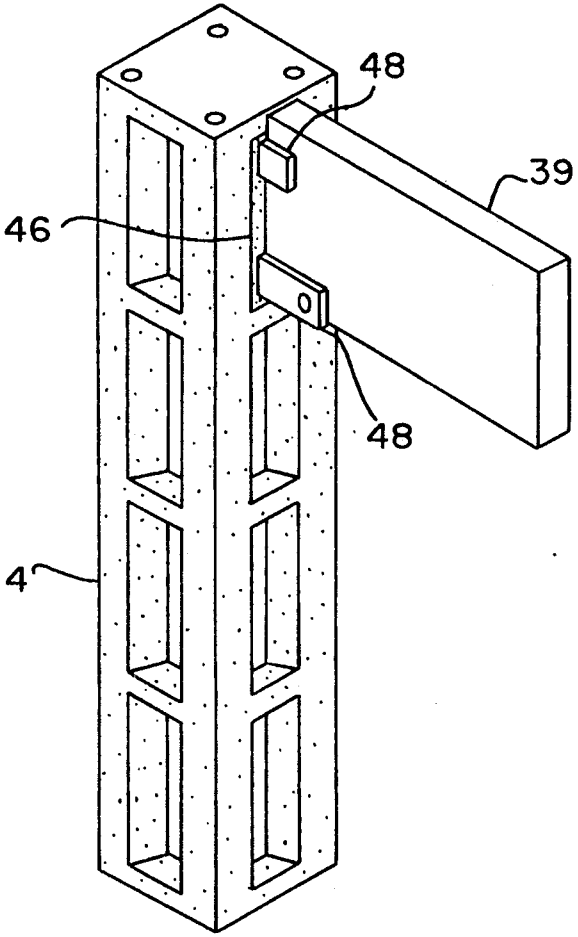
FIG. 28 is an isometric view showing one method of connecting a wood beam to an indentation of a precast vertical wall reinforcement.

In FIG. 28 a wooden beam 39 is connected to an indentation using steel connectors 48 fixed to the precast element's core with through bolts or screws. The corresponding indentations are then filled with concrete or mortar 46. FIG. 29 shows a similar connection, only here a steel joist 49 is joined to the precast element together with a tightener 50 which can provide for lateral bracing.

Figure 31:
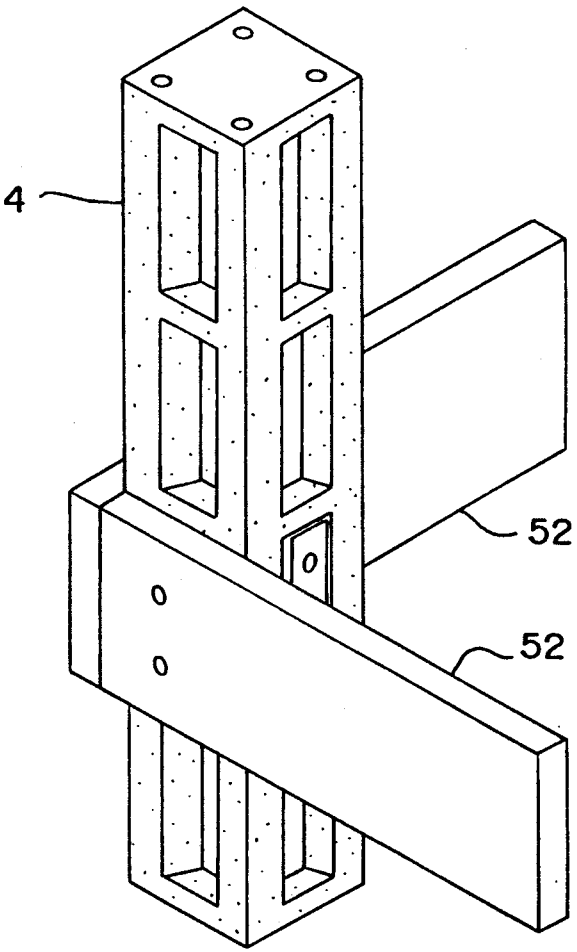
FIG. 31 is an isometric view showing one possible installation of hand rails using the indentation of a precast vertical wall reinforcement.
Figure 30:
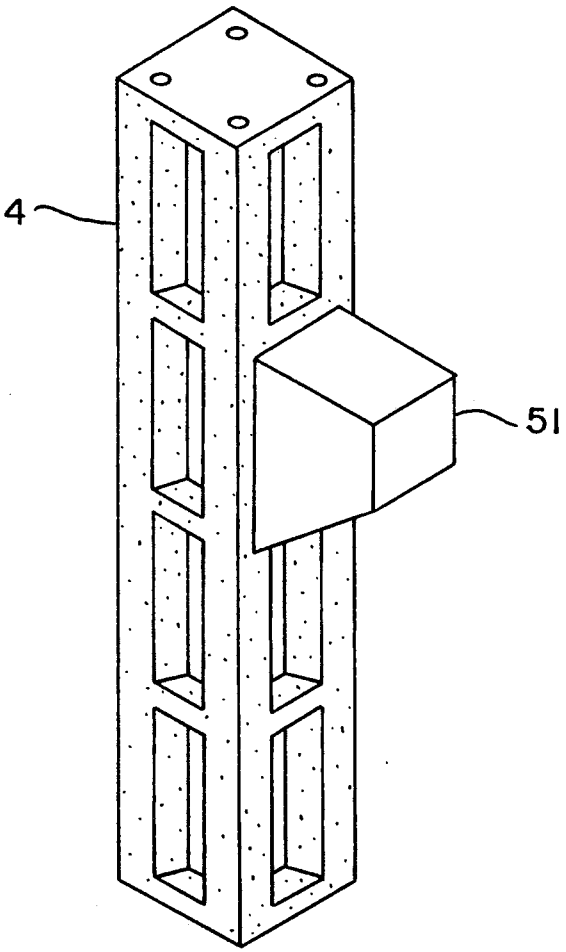
FIG. 30 is an isometric view showing the installation of a concrete bracket using one of the indentations of a precast vertical wall reinforcement.

FIG. 30 shows a concrete bracket 51 attached to the precast element, this can be easily done using the preparation of FIG. 22. Finally FIG. 31 shows provisional wood hand rails 52 fixed to the precast element by way of through bolts across its core. These elements could be used to provide protection for the workmen.

The invention claimed is:

1. A building structure comprising:

a plurality of vertical wall reinforcements comprised of elongate precast concrete members of rectangular form having internal longitudinal and transverse reinforcing bars and four planar outer surfaces, said longitudinal and transverse reinforcing bars being disposed with adjacent ones of said longitudinal reinforcing bars and adjacent ones of said transverse reinforcing bars defining rectangular patterns inward of said outer surfaces, and a plurality of indentations cast in said outer surfaces, each indentation being of substantial depth and positioned to overlay one of said rectangular patterns, brickwork joined to said vertical wall reinforcements, said brickwork being laid adjacent one of said outer surfaces of said precast concrete members and keyed to said precast concrete member by mortar in said indentations, and a plurality of steel reinforcements with a portion of each steel reinforcement embedded between two successive courses of brick and an end of each steel reinforcement embedded in mortar in an indentation of the precast concrete member facing said consecutive brick courses.

2. The building structure defined by claim 1, wherein said steel reinforcements comprise steel bars.

3. The building structure defined by claim 2, wherein said steel bars are bent at one end and said bent end of each steel bar is embedded in mortar in an indentation of the precast concrete member facing said consecutive brick courses.

4. A building structure comprising:

at least one vertical wall reinforcement comprised of an elongate precast concrete member of rectangular form having internal longitudinal and transverse reinforcing bars and four planar outer surfaces, said longitudinal and transverse reinforcing bars being disposed with adjacent ones of said longitudinal reinforcing bars and adjacent ones of said transverse reinforcing bars defining rectangular patterns inward of said outer surfaces, and a plurality of indentations cast in said outer surfaces, each indentation being of substantial depth and positioned to overlay one of said rectangular patterns, at least one hole extending through a core of said precast concrete member from a first indentation in one side of said precast concrete member to a second indentation in another side of said precast concrete member, a steel bar having a first portion laid in said first indentation and a straight portion extending through said hole and said second indentation, a horizontal reinforced concrete element having reinforcing bars that overlap a portion of said steel bar extending through said second indentation, and a cured cement mix filling said first and second indentations to secure said steel bar in said first and second indentations and to secure said reinforcing bars overlapping said steel bar whereby said horizontal reinforced concrete element is secured to one side of said precast concrete member.

5. The building structure defined by claim 4, wherein said first portion of said steel bar is a bent portion and said bent portion of said steel bar is secured in said first indentation by said cement mix.

6. A buliding structure comprising:

at least one vertical wall reinforcement comprised of an elongate precast concrete member of rectangular form having internal longitudinal and transverse reinforcing bars and four planar outer surfaces, said longitudinal and transverse reinforcing bars being disposed with adjacent ones of said longitudinal reinforcing bars and adjacent ones of said transverse reinforcing bars defining rectangular patterns inward of said outer surfaces, and a plurality of indentations cast in said outer surfaces, each indentation being of substantial depth and positioned to overlay one of said rectangular patterns, at least one hole extending through a core of said precast concrete member from a first indentation in one side of said precast concrete member to a second indentation in another side of said precast concrete member, at least one horizontal steel reinforcing bar extending through said hole and projecting outwardly of at least one of said first and second indentations, and a concrete member cast around said projecting reinforcing bar and into said at least one of said indentations, whereby said concrete member is reinforced by said projecting reinforcing bar and interlocked to said precast concrete member by said indentation.

* * * * *